US010329677B2

(12) United States Patent
Geioushy et al.

(10) Patent No.: US 10,329,677 B2
(45) Date of Patent: Jun. 25, 2019

(54) METHOD FOR ELECTROCHEMICAL REDUCTION OF CARBON DIOXIDE

(71) Applicant: KING FAHD UNIVERSITY OF PETROLEUM AND MINERALS, Dhahran (SA)

(72) Inventors: Ramadan A. Geioushy, Dhahran (SA); Mazen M. Khaled, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 188 days.

(21) Appl. No.: 15/340,686

(22) Filed: Nov. 1, 2016

(65) Prior Publication Data

US 2018/0119296 A1 May 3, 2018

(51) Int. Cl.

| | |
|---|---|
| ***C25B 3/00*** | (2006.01) |
| ***C25B 3/04*** | (2006.01) |
| ***C25B 11/04*** | (2006.01) |
| ***C25B 9/06*** | (2006.01) |

(52) U.S. Cl.

CPC ..... *C25B 3/04* (2013.01); *C25B 9/06* (2013.01); *C25B 11/0405* (2013.01); *C25B 11/0415* (2013.01); *C25B 11/0478* (2013.01)

(58) Field of Classification Search

CPC ..... C25B 3/04
USPC ..... 205/450
See application file for complete search history.

(56) References Cited

U.S. PATENT DOCUMENTS

2013/0026029 A1 1/2013 Kayaert et al.

FOREIGN PATENT DOCUMENTS

| | | |
|---|---|---|
| CN | 102520035 A | 6/2012 |
| CN | 103566934 B | 8/2015 |
| WO | 2015/051211 A2 | 4/2015 |

OTHER PUBLICATIONS

Albo et al., "Cu2O-Loaded Gas Diffusion Electrodes for the Continuous Electrochemical Reduction of CO2 to Methanol," Journal of Catalysis (2016), vol. 343, pp. 232-239. (Year: 2016).*

Pietrzak et al., "Morphology and Properties of the Graphene Layer on the Copper Substrate," Polish Journal of Chemical Technology (2015), vol. 17, No. 4, pp. 104-108. (Year: 2015).*

Qiao et al., "Formation of Cu Nanostructured Electrode Surfaces by an Annealing-Electroreduction Procedure to Achieve High-Efficiency CO2 Electroreduction," Electrochemistry Communications (2014), vol. 38, pp. 8-11. (Year: 2014).*

(Continued)

*Primary Examiner* — Edna Wong
(74) *Attorney, Agent, or Firm* — Oblon, McClelland, Maier & Neustadt, L.L.P.

(57) ABSTRACT

A method of electrochemically reducing $CO_2$ to form at least one alcohol, preferably ethanol. The method includes (a) contacting an electrode system with an aqueous solution comprising at least one electrolyte and $CO_2$, wherein the electrode system comprises a working electrode, a counter electrode, and a reference electrode, wherein the working electrode comprises a base electrode and a coating of a composite comprising graphene nanosheets and $Cu_2O$ nanoparticles disposed on a surface of the base electrode, and (b) applying a negative potential to the working electrode to reduce the $CO_2$ and form the at least one alcohol.

12 Claims, 14 Drawing Sheets

(56) References Cited

OTHER PUBLICATIONS

Khan et al., "Graphene Based Metal and Metal Oxide Nanocomposites: Synthesis, Properties and Their Applications," Journal of Materials Chemistry A (2015), vol. 3, pp. 18753-18808. (Year: 2015).*
Kuo et al., "Seed-Mediated Synthesis of Monodispersed Cu2O Nanocubes with Five Different Size Ranges from 40 to 420 nm," Adv. Funct. Mater. (2007), vol. 17, pp. 3773-3780. (Year: 2007).*
Alves, D.C.B., et al., "Copper Nanoparticles Stabilized by Reduced Graphene Oxide for $CO_2$ Reduction Reaction", Mater Renew Sustain Energy, vol. 4, No. 2, 7 pages total, (2015).
An, X., et al., "$CU_2O$/Reduced Graphene Oxide Composites for the Photocatalytic Conversion of $CO_2$", CHEMSUSCHEM, vol. 7, pp. 1086-1093, (2014).

* cited by examiner

METHOD FOR ELECTROCHEMICAL REDUCTION OF CARBON DIOXIDE

BACKGROUND OF THE INVENTION

Technical Field

The present disclosure relates to methods of electrochemical reduction of $CO_2$. More specifically, the present disclosure relates to methods of electrochemically reducing $CO_2$ to alcohols, preferably ethanol, on the surface of a cathode coated with a composite comprising graphene nanosheets and $Cu_2O$ nanoparticles.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, is neither expressly nor impliedly admitted as prior art against the present invention.

High levels of atmospheric carbon dioxide ($CO_2$) emitted, for example, from industry, fossil fuel combustion and utilities, have been linked to global climate change. A greenhouse effect from carbon dioxide is believed to be one cause of the warming phenomenon of the earth. To minimize global warming effects, removal of a portion of the existing, as well as new, quantities of carbon dioxide from the atmosphere is needed.

Electrochemical reduction of $CO_2$ to organic compounds, such as alcohols, offers a promising solution to reduce the atmospheric $CO_2$ level while producing useful chemical materials and fuels.

It is an object of the present disclosure to provide methods of electrochemically reducing $CO_2$ to alcohols on the surface of a cathode coated with a composite comprising graphene nanosheets and $Cu_2O$ nanoparticles. With the composite functioning as an electrocatalyst for $CO_2$ reduction, the cathode coated with a low amount of the composite advantageously converts $CO_2$ to alcohols, preferably ethanol, with a high faradaic efficiency and a high current density at a low reduction potential as compared to other electrocatalyst modified electrodes reported in the literature.

BRIEF SUMMARY OF THE INVENTION

According to a first aspect, the present disclosure relates to a method of reducing $CO_2$ to form at least one alcohol. The method includes (a) contacting an electrode system with an aqueous solution comprising at least one electrolyte and $CO_2$, wherein the electrode system comprises a working electrode, a counter electrode, and a reference electrode, wherein the working electrode comprises a base electrode and a coating of a composite comprising graphene nanosheets and $Cu_2O$ nanoparticles disposed on a surface of the base electrode, and (b) applying a negative potential to the working electrode to reduce the $CO_2$ and form the at least one alcohol.

In one or more embodiments, the contacting is performed in a divided electrochemical cell comprising the counter electrode in a first cell compartment and the working electrode in a second cell compartment, with each cell compartment containing the aqueous solution.

In one or more embodiments, the base electrode is selected from the group consisting of a metal base electrode, a carbon paper base electrode, a carbon cloth base electrode, a carbon felt base electrode, a graphite base electrode, a glassy carbon base electrode, and a conductive polymer base electrode.

In one or more embodiments, the metal base electrode comprises at least one metal selected from the group consisting of Cu, Al, Au, Ag, Zn, Ga, Hg, In, Cd, Ti, Pd, and Pt.

In one or more embodiments, the $Cu_2O$ nanoparticles are disposed on a surface of the graphene nanosheets in the composite.

In one or more embodiments, the $Cu_2O$ nanoparticles have an average particle size of 20-50 nm.

In one or more embodiments, a plurality of the $Cu_2O$ nanoparticles form a cubic cluster with the longest edge of 60-200 nm.

In one or more embodiments, the graphene nanosheets enclose or wrap around the cubic cluster of the $Cu_2O$ nanoparticles in the composite.

In one or more embodiments, the composite has a weight ratio of the graphene nanosheets: the $Cu_2O$ nanoparticles in the range of 0.2-0.8.

In one or more embodiments, an amount of the coating of the composite disposed on the surface of the base electrode is 0.01-0.5 mg/cm$^2$ surface area of the base electrode.

In one or more embodiments, the at least one alcohol comprises ethanol.

In one or more embodiments, the at least one alcohol comprises ethanol, the reference electrode is an Ag/AgCl reference electrode, and the negative potential is from −0.9 V to −1.3 V.

In one or more embodiments, the at least one alcohol comprises ethanol, the reference electrode is an Ag/AgCl reference electrode, the negative potential is from −0.9 V to −1.3 V, and the $CO_2$ is reduced to the ethanol at the working electrode with a faradaic efficiency of 5-10%.

In one or more embodiments, the at least one alcohol comprises ethanol, the reference electrode is an Ag/AgCl reference electrode, the negative potential is from −0.9 V to −1.3 V, and the working electrode has a current density of 0.5-3 mA/cm$^2$.

In one or more embodiments, the graphene nanosheets and the $Cu_2O$ nanoparticles are formed by reacting graphene oxide with at least one $Cu^{2+}$ salt in the presence of at least one hydroxylamine, and/or at least one salt of hydroxylamine, and/or at least one substituted derivative of hydroxylamine.

In one or more embodiments, the at least one electrolyte comprises at least one bicarbonate salt.

In one or more embodiments, a concentration of the at least one bicarbonate salt in the aqueous solution is 0.1-0.5 M.

In one or more embodiments, the aqueous solution has a pH of 6-8.

In one or more embodiments, the aqueous solution is saturated with the $CO_2$.

In one or more embodiments, the contacting in (a) and the applying in (b) are performed at a temperature of 4-50° C.

According to a second aspect, the present disclosure relates to an electrode system. The electrode system includes (a) a working electrode comprising a base electrode and a coating of a composite comprising graphene nanosheets and $Cu_2O$ nanoparticles disposed on a surface of the base electrode, wherein the composite has a weight ratio of the graphene nanosheets e the $Cu_2O$ nanoparticles in the range of 0.2-0.8, (b) a counter electrode, and (c) a reference electrode.

In one or more embodiments, the $Cu_2O$ nanoparticles have an average particle size of 20-50 nm.

In one or more embodiments, the $Cu_2O$ nanoparticles are disposed on a surface of the graphene nanosheets in the composite.

In one or more embodiments, an amount of the coating of the composite disposed on the surface of the base electrode is 0.01-0.5 mg/cm$^2$ surface area of the base electrode.

According to a third aspect, the present disclosure relates to a method of making the working electrode of the electrode system of the second aspect. The method includes (a) reacting graphene oxide with at least one $Cu^{2+}$ salt in the presence of at least one hydroxylamine, and/or at least one salt of hydroxylamine, and/or at least one substituted derivative of hydroxylamine and at least one surfactant in an alkaline aqueous solution to form a precipitate comprising the composite comprising graphene nanosheets and $Cu_2O$ nanoparticles, (b) suspending the precipitate in a dispersing media to form a dispersion comprising the composite, (c) depositing the dispersion on the surface of the base electrode to form a vet coating of the composite, and (d) drying the wet coating of the composite to form the coating of the composite comprising graphene nanosheets and $Cu_2O$ nanoparticles disposed on the surface of the base electrode.

The foregoing paragraphs have been provided by way of general introduction, and are not intended to limit the scope of the following claims. The described embodiments, together with further advantages, ill be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
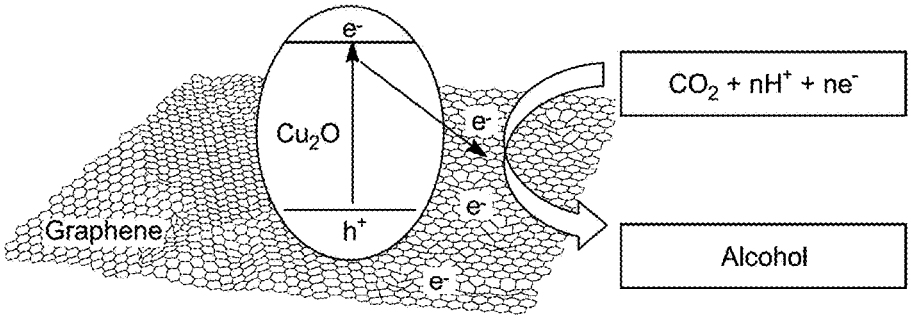
FIG. 1 is a schematic illustration of electron transfer from the $Cu_2O$ nanoparticles to the graphene nanosheets in the graphene nanosheets/$Cu_2O$ nanoparticles (GNs/$Cu_2O$ NPs) composite and electrochemical reduction of $CO_2$ to an alcohol.

The present disclosure relates to a method of reducing $CO_2$ to form at least one alcohol. The method includes (a) contacting an electrode system with an aqueous solution comprising at least one electrolyte and $CO_2$, wherein the electrode system comprises a working electrode, a counter electrode, and a reference electrode, wherein the working electrode comprises a base electrode and a coating of a composite comprising graphene nanosheets and $Cu_2O$ nanoparticles disposed on a surface of the base electrode, and (b) applying a negative potential to the working electrode to reduce the $CO_2$ and form the at least one alcohol.

The $CO_2$ used in the disclosed method can be obtained from any source, e.g. a $CO_2$ gas tank containing pure or concentrated $CO_2$, an exhaust stream from fossil-fuel burning power or industrial plants, from geothermal or natural gas wells or the atmosphere itself. Most preferably, $CO_2$ is obtained from concentrated point sources of its generation prior to its release into the atmosphere. For example, high concentration carbon dioxide sources are those frequently accompanying natural gas in amounts of 5 to 50%, those from flue gases of fossil fuel (coal, natural gas, oil, etc.) burning power plants, and nearly pure $CO_2$ exhaust of cement factories and from fermenters used for industrial fermentation of ethanol. Certain geothermal steams also contain significant amounts of $CO_2$. The capture and use of existing atmospheric $CO_2$ by the disclosed method allows $CO_2$ to be a renewable and unlimited source of carbon.

$CO_2$ is preferably bubbled into the aqueous solution, more preferably continuously, to fogy in an aqueous solution saturated with $CO_2$ to be reduced by the disclosed method.

In some embodiments, the at least one alcohol is at least one selected from the group consisting of methanol, ethanol, 1-propanol, and 2-propanol.

The base electrode for the working electrode may be made of any conductive material, non-limiting examples of which include carbon paper, carbon cloth, carbon felt, graphite, glassy carbon, one or more conductive polymers, such as polyfluorenes, polyphenylenes, polypyrenes, polyazulenes, polynaphthalenes, polypyrroles, polycarbazoles, polyindoles, polyazepines, polyanilines, polythiophenes, poly(3,4-ethylenedioxythiophene), poly(p-phenylene sulfide), polyacetylenes, and polyphenylene vinylene, and a metal, such as Cu, Al, Au, Ag, Zn, Ga, Hg, In, Cd, Ti, Pd, and Pt, and combinations thereof.

In the present disclosure, the composite functions as an electrocatalyst distinct from the base electrode which is merely an electrical conductor. An electrocatalyst is a catalyst that participates in electrochemical reactions. Catalyst materials modify and increase the rate of chemical reactions without being consumed in the process. Electrocatalysts are a specific form of catalysts that function at electrode surfaces. Without being bound by any particular theory, it is believed that the composite assists in transferring electrons between the working electrode and reactants that include $CO_2$, and/or facilitating intermediate chemical transformations described by an overall half-reaction.

In one embodiment, the composite comprises graphene nanosheets, $Cu_2O$ nanoparticles, and other materials, such as one or more noble metals (e.g. Pd, Ru, Rh, Pt, Au, and Ag) and/or their oxides (e.g. $RuO_2$ or $RuO_4$), and/or one or more other semi-conductors (e.g. GaP, GaAs, InP, InN, $WSe_2$, CdTe, $GaInP_2$, SiC, NiO and Si). The exemplary mass ratio of $Cu_2O$ to the other materials may be 100:1-1:100, 80:1-1:80 60:1-1:60, 40:1-1:40, 20:1-1:20, 10:1-1:10, 5:1-1:5, or 2:1-1:2.

In another embodiment, the composite consists of, or consists essentially of graphene nanosheets and $Cu_2O$ nanoparticles.

Graphene is an allotrope of carbon in the form of a two-dimensional, atomic-scale, hexagonal lattice in which one atom forms each vertex. Graphene is unique due to its excellent electrical conductivity, thermal and mechanical properties, and tremendously large surface area.

The graphene nanosheets preferably comprise graphene with a C/O ratio of 4 or higher, such as 5-25, 7-20, or 10-15.

In one embodiment, the graphene nanosheets comprise pristine graphene, for example, obtained by direct mechanical exfoliation (i.e. the "Scotch tape method") of individual layers of a pristine graphite material or by direct ultrasonication of a pristine graphite material that is not pre-intercalated and not pre-oxidized. The pristine graphitic material may be selected from the group consisting of natural graphite, synthetic graphite, highly oriented pyrolytic graphite, carbon or graphite fiber, carbon or graphitic nano-fiber, meso-carbon micro-bead, and combinations thereof.

In a preferred embodiment, the graphene nanosheets comprise reduced graphene oxide, a kind of chemically derived or converted graphene prepared by reduction of graphene oxide such that the residual functional groups of graphene oxide, such as hydroxyl, epoxy, and carbonyl functional groups, may interact with $Cu_2O$ to result in an intimate contact between the graphene nanosheets and the $Cu_2O$ nanoparticles in the composite.

Graphite oxide has a similar layered structure to graphite, but the plane of carbon atoms in graphite oxide is heavily decorated by oxygen-containing groups, which not only expand the interlayer distance but also make the atomic-thick layers hydrophilic. As a result, these oxidized layers can be exfoliated in water under moderate ultrasonication. If the exfoliated sheets contain only one or few layers of carbon atoms like graphene, these sheets are named graphene oxide (GO).

The widely accepted structural model of GO is a nonstoichiometric model, wherein the carbon plane is decorated with hydroxyl and epoxy (1,2-ether) functional groups. Carbonyl groups are also present, most likely as carboxylic acids along the sheet edge but also as organic carbonyl defects within the sheet. Nuclear magnetic resonance (NMR) spectroscopy studies of GO have indicated the presence of 5- and 6-membered lactols on the periphery of graphitic platelets as well as the presence of esters and tertiary alcohols on the surface, though epoxy and alcohol groups on the plane are still dominant GO can be (partly) reduced to graphene-like sheets by removing the oxygen-containing groups with the recovery of a conjugated structure. The reduced GO (rGO) sheets are usually considered as one kind of chemically derived graphene. For a more detailed review of graphene oxide and reduced graphene oxide, see The reduction of graphene oxide, Songfeng Pei, Hui-Ming Cheng, Carbon, Volume 50, Issue 9, August 2012, Pages 3210-3228, incorporated herein by reference in its entirety.

In some embodiments, each of the graphene nanosheets in the composite has a lateral dimension (i.e. length or width) of 5-9000 nm, 50-8000 nm, 100-7000 nm, 500-6000 nm, 800-5000 nm, 1000-4000 nm, 2000-3000 nm, 100-1000 nm, 200-900 nm, 300-800 nm, or 400-600 nm, and a thickness of about 0.3-4.5 nm corresponding to about 1-15 layers of graphene, about 0.6-3.6 nm corresponding to about 2-12 layers of graphene, about 0.9-2.7 nm corresponding to about 3-9 layers of graphene, about 1.2-1.8 nm corresponding to about 4-6 layers of graphene, about 0.3-0.9 nm corresponding to 1-3 layers of graphene.

In a preferred embodiment, the graphene nanosheets comprise wrinkled graphene nanosheets, which have a larger surface area contacting the $Cu_2O$ nanoparticles and are more stable, i.e. without easily reverting to the graphitic form, as compared to non-wrinkled graphene nanosheets. The widths of the wrinkles on the graphene nanosheets may vary. In some embodiments, the width may range from about less than 1 nm to about 200 nm. In other embodiments, the width may range from about 5 nm to about 150 nm, from about 10 nm to about 100 nm, or from about 25 nm to about 75 nm. Additionally, the heights of the 10 wrinkles (the distances from the base of the wrinkles to the top of the wrinkles) on the graphene nanosheets can vary. In some embodiments, the heights may range from about 0.5 nm to about 10 nm. In other embodiments, the heights may range from about 0.9 nm to about 8 nm, or from about 2 nm to about 6 nm.

In some embodiments, the wrinkled graphene nanosheets have at least 10, preferably 15 at least 50, more preferably at least 100, more preferably at least 250, or more preferably at least 500 wrinkles per 1,000 micrometers of the graphene.

In a preferred embodiment, the $Cu_2O$ nanoparticles contact the graphene nanosheets. For example, the $Cu_2O$ nanoparticles are dispersed, or disposed on a surface of the graphene nanosheets, and the graphene nanosheets provide support for the $Cu_2O$ nanoparticles. Alternatively, the $Cu_2O$ nanoparticles are sandwiched between two surfaces of the graphene nanosheets, or are partially or completely enclosed by the graphene nanosheets. In some embodiments, the $Cu_2O$ nanoparticles are spherical and have an average particle size (diameter) of 5-100 nm, 10-80 nm, 15-60 nm, 20-50 nm, or 30-40 nm.

In another preferred embodiment, a plurality of the $Cu_2O$ nanoparticles foil a cubic cluster with the longest edge of 60-200 nm, 80-150 nm, or 100-120 nm. The cubic cluster of the $Cu_2O$ nanoparticles may be attached to a surface of the graphene nanosheets, sandwiched between two surfaces of the graphene nanosheets, or partially or completely enclosed or wrapped around by the graphene nanosheets.

Referring to FIG. 1, without being bound by theory, it is believed that the contacting of the graphene nanosheets with the $Cu_2O$ nanoparticles advantageously facilitates electron transfer from the $Cu_2O$ nanoparticles to the graphene nanosheets, which in turn transfer the electrons to $CO_2$ to form alcohols. The contacting also increases the stability of the $Cu_2O$ nanoparticles by, for example, graphene nanosheets preventing $Cu_2O$ from being oxidized to form CuO and/or preventing $Cu_2O$ from being reduced to form Cu.

In some embodiments, in the composite the weight ratio of the graphene nanosheets: the $Cu_2O$ nanoparticles lies in the range of 0.1-1, 0.2-0.8, 0.2-0.6, or 0.3-0.5.

In one embodiment, the composite comprising or consisting of the graphene nanosheets and the $Cu_2O$ nanoparticles is prepared by making graphene nanosheets and the $Cu_2O$ nanoparticles separately and mixing the resulting graphene nanosheets and the $Cu_2O$ nanoparticles.

In a preferred embodiment, the graphene nanosheets and the $Cu_2O$ nanoparticles in the composite are formed by producing the graphene nanosheets and the $Cu_2O$ nanoparticles together in a single process or a set of chemical reactions which advantageously results in an intimate contact between the graphene nanosheets and the $Cu_2O$ nanoparticles. For example, the graphene nanosheets and the $Cu_2O$ nanoparticles in the composite may be formed by reacting graphene oxide with a $Cu^{2+}$ salt in the presence of a reductant, such as a hydroxylamine (e.g. $NH_2OH$), a salt of a hydroxylamine (e.g. $NH_2OH.HCl$), or a substituted derivative of a hydroxylamine that may be an O-hydroxylamine or an N-hydroxylamine (e.g. N-methylhydroxylamine, N,N-diethylhydroxylamine, and ethyl(hydroxyethyl)hydroxylamine), preferably under an alkaline condition and in the presence of a surfactant (e.g. sodium dodecyl sulfate (SDS)), with the resulting graphene nanosheets comprising reduced graphene oxide and $Cu_2O$ nanoparticles co-precipitating from the reaction mixture. For another example, the graphene nanosheets/$Cu_2O$ nanoparticles composite may be prepared by a microwave-assisted hydrothermal reaction with a $Cu^{2+}$ salt, graphene oxide, and formic acid as reactants, as described by Xiaogiang An, Kimfung Li, and Junwang Tang, $Cu_2O$/Reduced Graphene Oxide Composites for the Photocatalytic Conversion of $CO_2$, ChemSusChem. 2014 April; 7(4): 1086-1093, incorporated herein by reference in its entirety.

The coating of the composite on the surface of the base electrode may be accomplished by first making a separately formed layer of the composite and then disposing the pre-formed layer of the composite on the surface of the base electrode, or by forming a coating or layer of the composite on the surface of the base electrode by means of, without limitation, vapor deposition, chemical vapor deposition, physical vapor deposition, laminating, pressing, rolling, soaking, melting, gluing, sol-gel deposition, spin coating, dip coating, bar coating, brushing coating, sputtering, thermal spraying, flame spray, plasma spray, high velocity oxy-fuel spray, atomic layer deposition, cold spraying, aerosol deposition, or sputtering.

In a preferred embodiment, the coating is performed by applying a dispersion comprising the composite, a dispersing media (e.g. water, methanol, ethanol, or acetone), and optionally a binder to the surface of the base electrode. The dispersion may be homogenized by ultrasound prior to the application to the surface of the base electrode. After the dispersion is applied to the surface of the base electrode, the dispersion may be dried at room temperature, or the coated electrode may be heated at a sufficient temperature (e.g. between room temperature and 300° C., between 50° C. and 200° C., or between 80° C. and 150° C.) and length of time (e.g. between 10 seconds and 2 hours, or between 5 minutes and 1 hour) to evaporate substantially all the dispersing media (e.g. at least 90%, at least 95%, or at least 99% of the dispersing media) from the dispersion. The dispersion may be applied to the surface of the base electrode by other methods that include, without limitation, slot/dip/spin coating, brushing, rolling, soaking, melting, gluing, or spraying the dispersion on the surface of the base electrode. A propellant can be used to spray the dispersion onto the surface of the base electrode.

In one embodiment, there is a distinct interface between the coating of the composite and the surface of the base electrode. In another embodiment, the coating of the composite may be incorporated into the surface of the base electrode, e.g. at least partially embedded within the surface of the base electrode.

Depending on the amount of the composite and the surface area of the base electrode to be coated by the composite, the composite coating may cover at least about 30%, at least about 50%, at least about 70%, at least about 90%, or at least about 95% of the base electrode surface, and/or may have a thickness of 1-1000 μm, 50-900 μm, 100-800 μm, 200-600 μm, or 300-500 μm. The ratio of the composite mass : surface area of the base electrode may vary without limitation, depending on, for example, the desired catalytic activity of the composite for electrochemically reducing $CO_2$, the desired faradaic efficiency with which the alcohols are produced from the electrochemical reduction of $CO_2$, and the stability of the composite under various operating conditions of the working electrode. In some embodiments, the amount of the coating of the composite disposed on the surface of the base electrode is 0.01-0.5 $mg/cm^2$, 0.05-0.4 $mg/cm^2$, 0.1-0.3 $mg/cm^2$, preferably 0.01-0.08 $mg/cm^2$, more preferably 0.02-0.06 $mg/cm^2$, more preferably 0.03-0.05 $mg/cm^2$ surface area of the base electrode.

In the disclosed electrode system, the counter electrode, along with the working electrode, provides a circuit over which current is measured. The potential of the counter electrode can be adjusted to balance the reaction occurring at the working electrode. The counter electrode can be made of an electrochemically inert material that does not react with the aqueous solution and conducts well. The counter electrode of the present disclosure can be fabricated from a conducting or semiconducting material such as platinum, gold, or carbon.

In the disclosed electrode system, the reference electrode provides a stable and well-known electrode potential, against which the potential of the working electrode is measured. The potential of the reference electrode in the electrochemical instrument of the present disclosure is defined as zero ("0"). The potential of the working electrode lower than the reference electrode means the potential is negative, and the potential of the working electrode higher than the reference electrode means the potential is positive. The stability of the reference electrode in the disclosed electrode system is maintained by not passing current over it. The counter electrode passes all the current needed to balance the current observed at the working electrode. In one embodiment, the reference electrode is an Ag/AgCl reference electrode. In another embodiment, the reference electrode is a hydrogen electrode. In another embodiment, the reference electrode is a saturated calomel electrode. In another embodiment, the reference electrode is a copper-copper (II) sulfate electrode. In still another embodiment, the reference electrode is a palladium-hydrogen electrode.

In the present disclosure, a negative potential is applied to the working electrode, making the working electrode operate as a cathode to which $CO_2$ is exposed and on which the electrochemical reduction of $CO_2$ takes place, and the counter electrode operate as an anode on which electrooxidation takes place.

In one embodiment, the disclosed method is performed with the electrode system placed in an undivided electrochemical cell. i.e. the working electrode and the counter electrode are placed in a single electrochemical cell compartment containing the aqueous solution. The undivided electrochemical cell may be constructed from non-transparent materials such that light does not reach the composite comprising graphene nanosheets and $Cu_2O$ nanoparticles present on the surface of the working electrode.

To prevent any byproducts generated at the counter electrode from contaminating the reduction products of $CO_2$ generated at the working electrode, and/or prevent the reduction products of $CO_2$ from being oxidized at the counter electrode, in a preferred embodiment, the method is performed in a divided electrochemical cell, with the counter electrode in a first cell compartment and the working electrode in a second cell compartment, and with each cell compartment containing the aqueous solution. The cell compartment of the counter electrode is separated from the cell compartment of the working electrode with a porous separator that permits the diffusion of the electrolyte while restricting the flow of the products and reactants. The porous separator may be of porous paper, rubber, glass (e.g. a porous glass frit), porcelain, polyvinylchloride, polyester, polytetrafluoroethene, polypropylene, etc.

The divided electrochemical cell may be constructed from non-transparent materials such that light does not reach the composite comprising graphene nanosheets and $Cu_2O$ nanoparticles present on the surface of the working electrode.

Since the working electrode reduces $CO_2$ to form an alcohol, in the divided electrochemical cell, $CO_2$ is preferably supplied to the cell compartment of the working electrode before and during the electrochemical reduction of $CO_2$, for example, by bubbling $CO_2$ into the electrolyte solution in the working electrode cell compartment, preferably continuously to saturate the electrolyte solution, i.e. make the aqueous solution saturated with $CO_2$.

The electrolyte in the aqueous solution may be any electrolyte that does not undergo chemical reaction across the potential range used for the electrochemical reduction of $CO_2$ and is not consumed during electrochemical reduction of $CO_2$. The electrolyte is preferably a salt, such as KCl and/or $NaNO_3$, or more preferably a bicarbonate salt, such as $KHCO_3$ and/or $NaHCO_3$. The concentration of the electrolyte in the aqueous solution is preferably 0.1-1 M, 0.3-0.8 M, more preferably 0.4-0.6 M, or more preferably 0.1-0.5 M.

The pH of the aqueous solution is preferably maintained at 5-9, or 6-8, or more preferably 6.5-7.5, for example, with a buffer, such as an acetate buffer containing sodium acetate and acetic acid, a phosphate buffer containing sodium phosphate dibasic and potassium phosphate monobasic, and a buffer containing sodium tetraborate and hydrochloric acid.

The disclosed method may be performed at a temperature of 4-50° C., preferably 10-40° C., more preferably 15-30° C., more preferably 20-25° C., and at a pressure of 0.1-10 bars, preferably 0.5-8 bars, preferably 1-5 bars, more preferably 1-3 bars. The kinetics of the electrochemical reduction of $CO_2$ may increase with increased temperature, however, the solubility of the $CO_2$ in the aqueous solution is decreased with increased temperature. The alcohol product yield can be increased with increased pressure due to the increased solubility of $CO_2$ at higher pressures. Thus, various temperatures and pressures can be utilized to produce the alcohol efficiently with a high yield.

In a preferred embodiment, the disclosed method utilizes an Ag/AgCl reference electrode with the negative potential of from −0.7 V to −1.5 V, from −0.9 V to −1.3 V, or −1.1V on the working electrode to electrochemically reduce $CO_2$ to ethanol, or two or more alcohols that include ethanol. In some embodiments, the working electrode has a current density of 0.1-6 mA/cm$^2$, 0.2-5 mA/cm$^2$, 0.5-3 mA/cm$^2$, or 1-2.5 mA/cm$^2$, and the ethanol is produced with a faradaic efficiency of 5-20%, 5-10%, 8-15%, or 10-12% at the working electrode and with a yield of 5-80, 10-70, 20-60, or 30-50 ppm per hour per gram of the graphene nanosheets/$Cu_2O$ nanoparticles composite.

In one embodiment, the method further comprises feeding the aqueous solution comprising the at least one alcohol (product) to a separation unit and separating the at least one alcohol (product) from the aqueous solution by, for example, distillation. When ethanol is produced or is among the alcohols produced, ethanol may be separated from the aqueous solution by other methods, such as those described in U.S. Pat. No. 9132410 B2, Compositions, systems and methods for separating ethanol from water and methods of making compositions for separating ethanol from water; U.S. Pat. No. 4,382,001 A, Use of activated carbon for separation of ethanol from water; and U.S. Pat. No. 4,492,808 A, Method for separating ethanol from an ethanol containing solution; each incorporated by reference in its entirety.

Having generally described this invention, a further understanding can be obtained by reference to certain specific examples which are provided herein for purposes of illustration only and are not intended to be limiting unless otherwise specified.

EXAMPLE 1

Materials and Methods

Graphite powder and sodium nitrate ($NaNO_3$, 98%) were obtained from Koch-Light Laboratories Ltd. Sulfuric acid ($H_2SO_4$, 95-97%), potassium permanganate ($KMnO_4$, 99.5%), and ethanol (99.9%) were purchased from Fluka. Hydrogen peroxide solution (30%, w/v), copper chloride, sodium dodecyl sulfate (SDS), sodium hydroxide, and hydroxylamine hydrochloride were obtained from BDH Chemicals Ltd. All of the chemicals were used as received without any purification. All the water used was ultrapure water.

X-ray diffraction (XRD) data were collected using a Rigaku MiniFlex X-ray diffractometer (Japan) to identify phases present in the synthesized samples, with the following parameters: Cu $K_{\alpha 1}$ radiation (g=0.15416 nm), accelerating voltage=30 kV and tube current=10 mA.

The samples were examined under a field emission scanning electron microscope (FE-SEM, Lyra 3, Tescan, Czech Republic) using both secondary electron (SE) and backscattered electron (BSE) detectors, with accelerating voltages of 20-30 kV in order to characterize grain morphologies, and an energy dispersive X-ray spectroscope (EDX, Oxford Inc., UK) was used for elemental analysis of the phases present.

Raman spectroscopy (Raman) pattern was analyzed in the range of from 500 to 200 $cm^{-1}$.

Transmission electron microscopy (TEM) was conducted at 200 KV using a JEM 2100F model transmission electron microscope (Japan) to obtain TEM and high-resolution TEM (HR-TEM) images.

Electrochemical reduction of $CO_2$ was carried out in a three-electrode cell where a Pt electrode and an Ag/AgCl electrode were used as the counter electrode and the reference electrode, respectively. A graphene nanosheets/$Cu_2O$ nanoparticles composite coated copper electrode with a surface area of 3.38 $cm^2$ was used as the working electrode. A divided two compartment electrochemical cell was connected with a potentiostat (Gamry) for electrochemical measurements. 30 ml of a 0.5 M $NaHCO_3$ (pH=7.25) solution were used as the electrolyte solution. Linear sweep voltammetry (LSV) was scanned in the range from −0.2 to −1.8 V vs Ag/AgCl with a scan rate of 20 mV/s. Prior to the electrochemical measurements to evaluate the working electrode behavior, the electrolyte solution was saturated with $N_2$ or $CO_2$ of high purity (99.99%). Current responses of the working electrode were measured at different potentials via a chronoamperometry process in the $CO_2$-saturated electrolyte solution. All of the electrochemical measurements were carried out at room temperature. The liquid product was analyzed by GC-MS (Agilent technologies). Helium gas was used as carrier gas and 0.2 ul of the liquid samples were injected. Column temperature was held at 40° C. for 5 min, and increased at 10° C./min up to 200° C. and held for 10 min. Faradaic efficiency was calculated assuming that 12 electrons are required per ethanol molecule produced using the following equation:

$$FE\ (\%)=(Z.N.F/q)\times 100$$

Where Z is the number of electrons, N is the number of moles produced, and q is the total charge applied during the electrolysis process.

Graphene oxide (GO) was synthesized using modified Hummers' methods as described previously. See A. A. Ismail, R. A. Geioushy, H. Bouzid, S. A. Al-Sayari, A. Al-Hajry, D. W. Bahnemann, $TiO_2$ decoration of graphene layers for highly efficient photocatalyst: Impact of calcination at different gas atmosphere on photocatalytic efficiency, *Appl. Catal. B: Environ.* 129 (2013) 62-70, incorporated herein by reference in its entirety.

Figure 2:
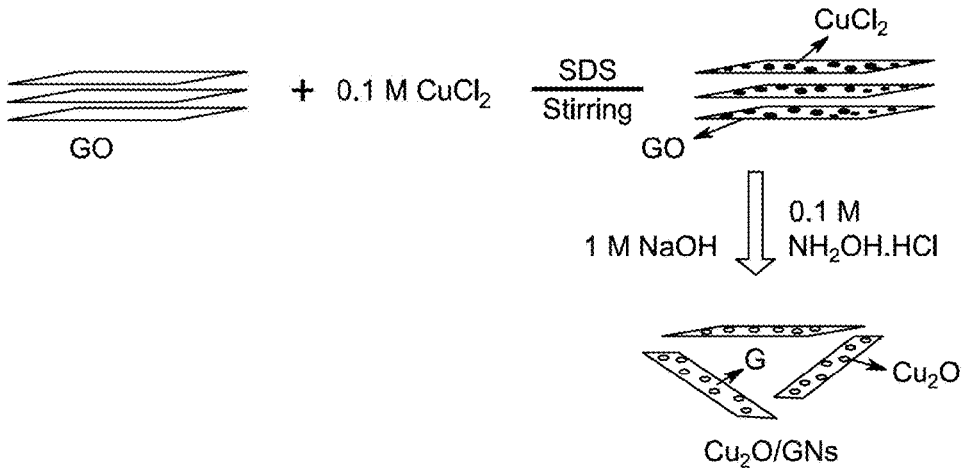
FIG. 2 is a schematic illustration for the synthesis of the graphene nanosheets/$Cu_2O$ nanoparticles composite $Cu_2O$/GNs according to Example 1.

Cuprous oxide ($Cu_2O$) and graphene nanosheets/$Cu_2O$ nanoparticles (GNs/$Cu_2O$ NPs) composite were synthesized according to the method described by M. Liu, R. Liu, W. Chen, Graphene wrapped Cu2O nanocubes: Non-enzymatic electrochemical sensors for the detection of glucose and hydrogen peroxide with enhanced stability, Biosensors and Bioelectronics 45 (2013) 206-212, incorporated herein by reference in its entirety. The reaction of graphene oxide with $CuCl_2$ in the presence of $NH_2OH.HCl$ as a reducing agent and in an alkaline medium to form the graphene nanosheets/$Cu_2O$ nanoparticles composite ($Cu_2O$/GNs) is shown in FIG. 2. Specifically, a 1 mg/ml GO solution was prepared and sonicated for 2 hr. To make the graphene nanosheets/$Cu_2O$ nanoparticles composite with the graphene nanosheets:$Cu_2O$ nanoparticles weight ratio of 50% (i.e. 50% GNs/$Cu_2O$ NPs (S2)), 3 ml of the 1 mg/ml GO solution were dissolved in 15.1 ml of ultrapure water and the resulting solution was sonicated for 30 min. 0.45 ml of 0.1 M $CuCl_2$ and 0.087 g of SDS were added to the above solution, and the resulting mixture was stirred for 1 hr. Thereafter, 0.9 ml of 1 M NaOH were added to the mixture followed by a rapid injection of 4 ml of 0.1 M $NH_2OH.HCl$ and stirring for 30 min for growth of the nanoparticles. Yellowish brown precipitate formed was centrifuged and washed with ethanol and water several times to remove the undesirable impurities and surfactant. $Cu_2O$ nanoparticles alone and the graphene nanosheets/$Cu_2O$ nanoparticles composite with the graphene nanosheets:$Cu_2O$ nanoparticles weight ratio of 30% (i.e. 30% GNs/$Cu_2O$ NPs (Si)) were prepared by the same method, except for the addition of the GO solution in preparing the $Cu_2O$ nanoparticles alone and an adjustment in the amount of the GO solution used in preparing 30% GNs/$Cu_2O$ NPs (S1).

To fabricate the working electrode, a 3.38 $cm^2$ copper foil (Fisher Scientific) was mechanically polished using silicon carbide grain (150 mesh), ultrasonically rinsed successively in diluted sulfuric acid ($H_2SO_4$), acetone, and ultrapure water, and then dried in nitrogen atmosphere. Thereafter, 1 mg of prepared powder ($Cu_2O$ nanoparticles or GNs/$Cu_2O$ NPs) was dispersed in 60 μl nafion solution (5 wt. %) and 1 ml acetone, and then sonicated for 15 min. A portion of the suspension ink (100 μl) was dropped on the copper foil and dried under a hot incandescent lamp.

EXAMPLE 2

Synthesis and Characterization of GNs/$Cu_2O$ NPs

Figure 3:
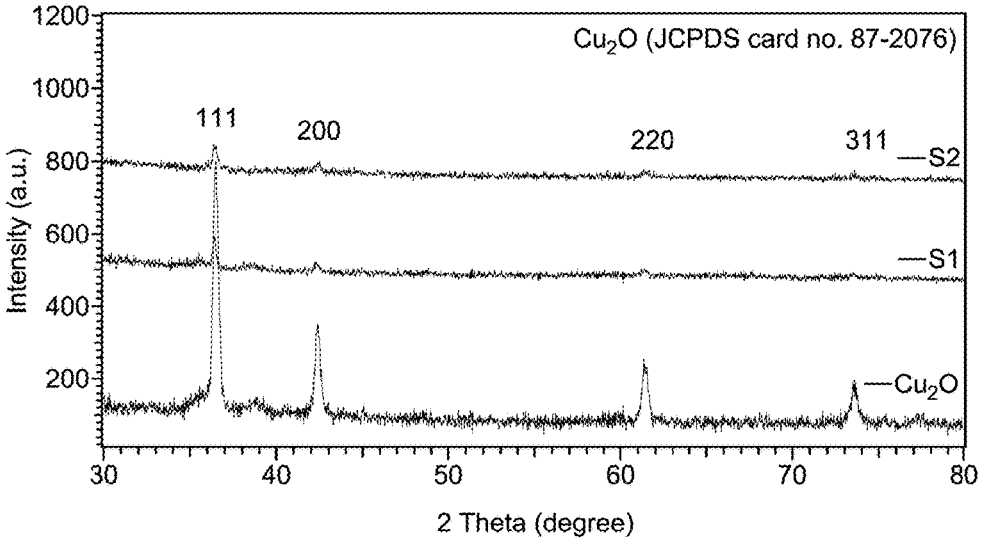
FIG. 3 is a graphical presentation of the XRD patterns of $Cu_2O$, the 30% GNs/$Cu_2O$ NPs composite (S1), and the 50% GNs/$Cu_2O$ NPs composite (S2) according to Example 2.

FIG. 3 shows the XRD patterns of $Cu_2O$ and GNs/$Cu_2O$ NPs composites S1 and S2, with the peaks at 2 theta angles of 36.4°, 42.3°, 61.3°, and 73.5° corresponding to the reflection from (111), (200), (220), and (311) cubic crystal structure of the $Cu_2O$ planes, respectively. These results agreed with JCPDS file no. 87-2076 for cubic $Cu_2O$. See M. Liu, R. Liu, W. Chen, Graphene wrapped $Cu_2O$ nanocubes: Non-enzymatic electrochemical sensors for the detection of glucose and hydrogen peroxide with enhanced stability, *Biosensors and Bioelectronics* 45 (2013) 206-212; and T-Y. Chang, R-M. Liang, P-W. Wu, J-Y. Chen, Y-Ch. Hsieh, Electrochemical reduction of $CO_2$ by $Cu_2O$-catalyzed carbon clothes, *Mater. Lett.* 63 (2009) 1001-1003, each incorporated herein by reference in its entirety. The XRD data also revealed the crystallinity of $Cu_2O$ without impurities and the crystalline size of $Cu_2O$ in the range of 40-60 nm. That the peaks of $Cu_2O$ alone without the support of graphene nanosheets are sharper and narrower than those of the GNs/$Cu_2O$ NPs composites indicates the role of graphene in controlling the size of the $Cu_2O$ nanoparticles/cubes, consistent with the reaction mechanism proposed by M. Liu et al. (2013) that the reduction of Cu (II) in an alkaline solution in the presence of $NH_2OH.HCl$ and SDS as surfactant prevented the agglomeration of $Cu_2O$ (See M. Liu, R. Liu, W. Chen, Graphene wrapped $Cu_2O$ nanocubes: Non-enzymatic electrochemical sensors for the detection of glucose and hydrogen peroxide with enhanced stability, *Biosensors and Bioelectronics* 45 (2013) 206-212, incorporated herein by reference in its entirety). Graphene is used as a catalyst support due to its unique properties, such as high surface area and high electron mobility, which enhance the catalytic performance of the $Cu_2O$ nanoparticles.

Figure 4:
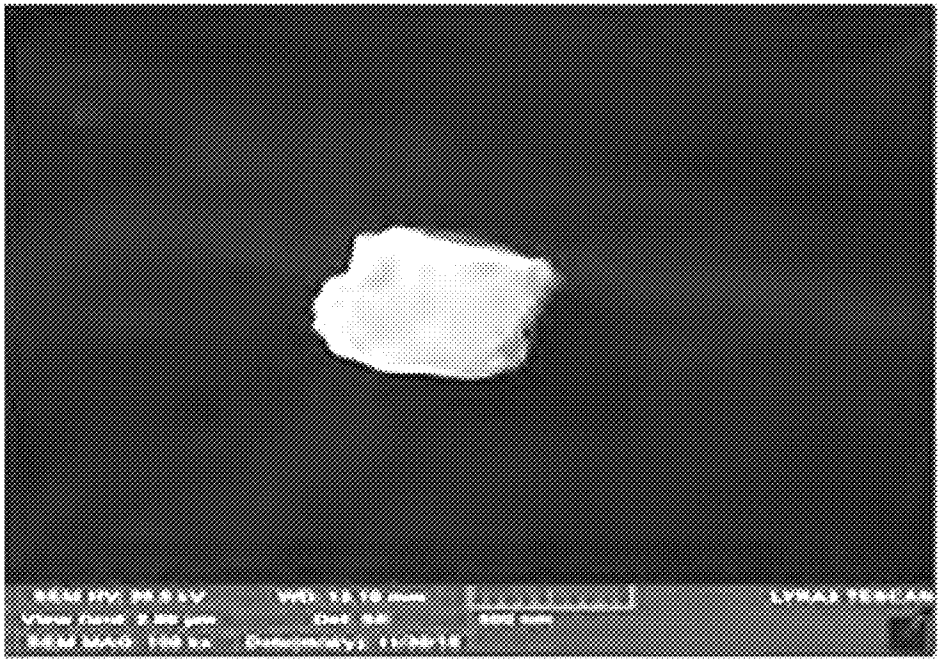
FIG. 4 is an FE-SEM image of $Cu_2O$ according to Example 2.
Figure 5:
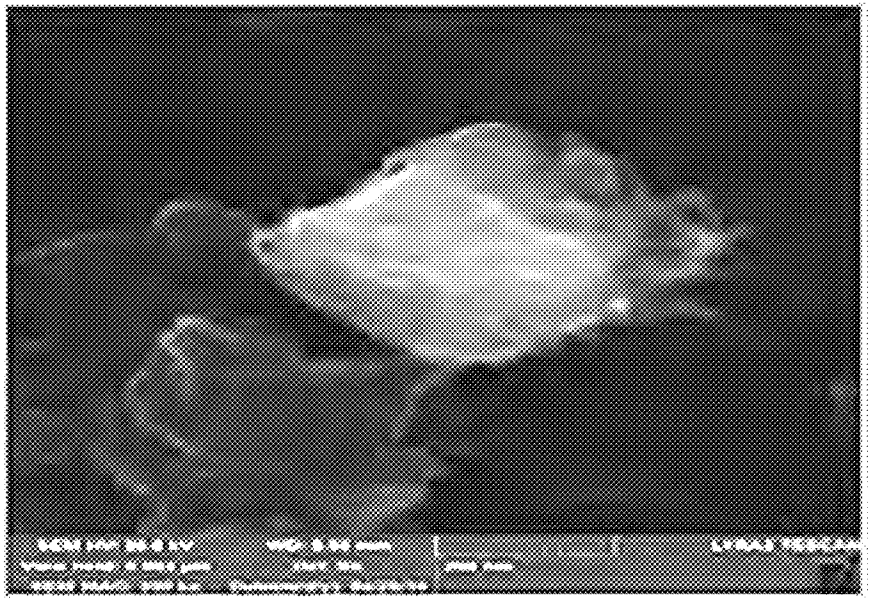
FIG. 5 is an FE-SEM image of the 30% GNs/$Cu_2O$ NPs composite (S1) according to Example 2.
Figure 6:
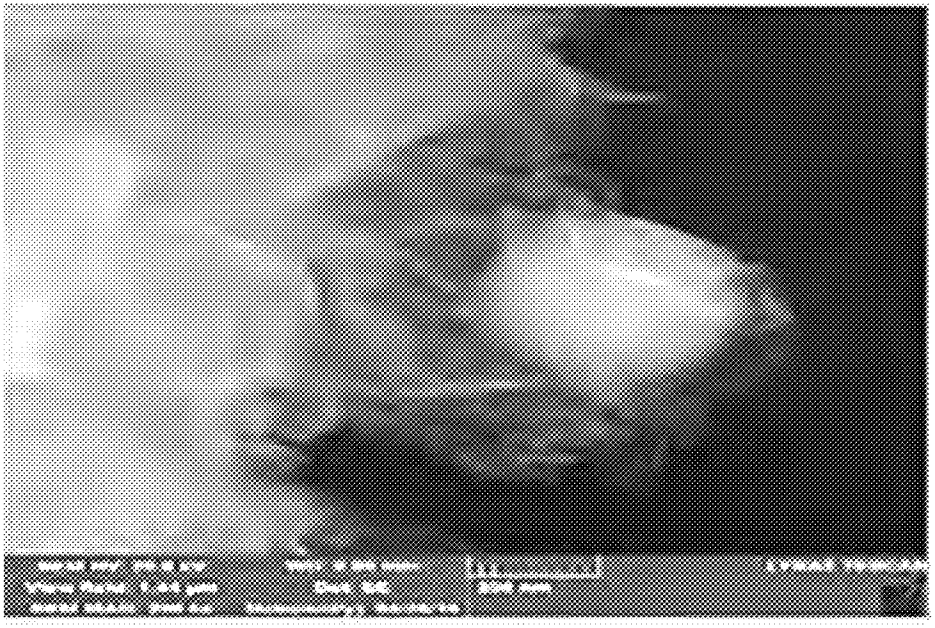
FIG. 6 is an FE-SEM image of the 50% GNs/$Cu_2O$ NPs composite (S2) according to Example 2.
Figure 7:
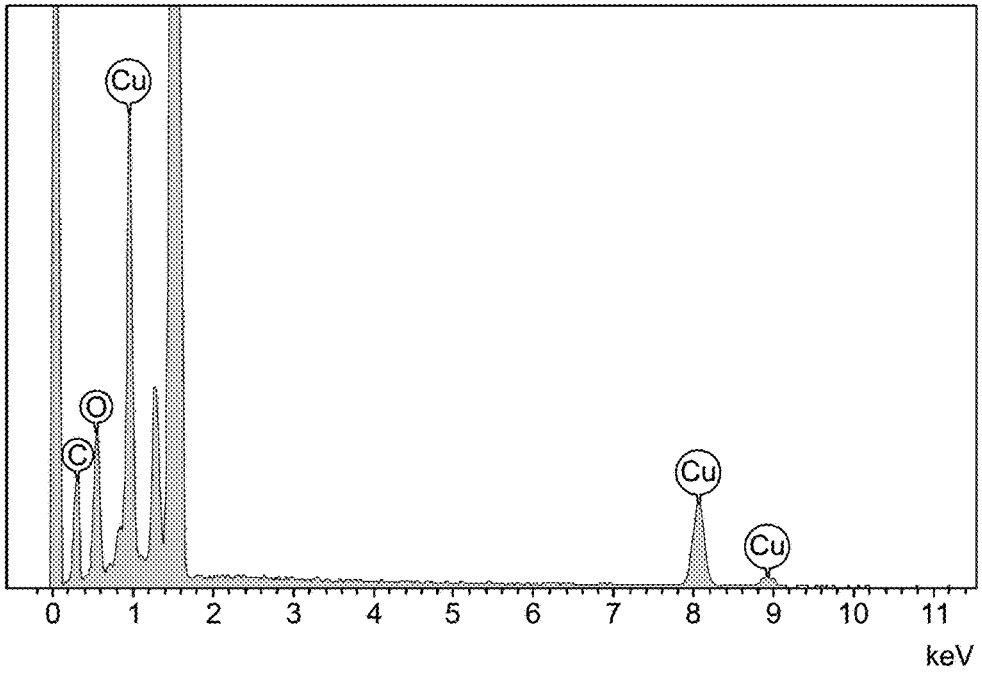
FIG. 7 is a graphical presentation of the EDX analysis result of the 50% GNs/$Cu_2O$ NPs composite (S2) according to Example 2.

FIGS. 4-6 are FE-SEM images showing the surface morphology of $Cu_2O$ and the GNs/$Cu_2O$ NPs composites. FIG. 4 shows the cubic structure of a cluster of $Cu_2O$ nanoparticles resulting from agglomeration of $Cu_2O$ nanoparticles and having the cubic edge length of 200-500 nm. By contrast, referring to FIGS. 5 and 6, in GNs/$Cu_2O$ NPs composites graphene wrapped $Cu_2O$ nanoparticles very well and kept the cubic shape of the $Cu_2O$ nanoparticle cluster. The size of the cubic cluster of $Cu_2O$ nanoparticles dispersed on graphene was reduced to around 200 nm, smaller than that of the cubic cluster of $Cu_2O$ nanoparticles unsupported by graphene, consistent with the XRD results that graphene had an effect on controlling the size of the cubic cluster of $Cu_2O$ nanoparticles and electron transfer from the $Cu_2O$ nanoparticles to graphene during the electrochemical reduction of $CO_2$ catalyzed by the GNs/$Cu_2O$ NPs composites. The Cu, O, and C peaks in the EDX analysis shown in FIG. 7 are also in good agreement with the XRD results.

Figure 8:
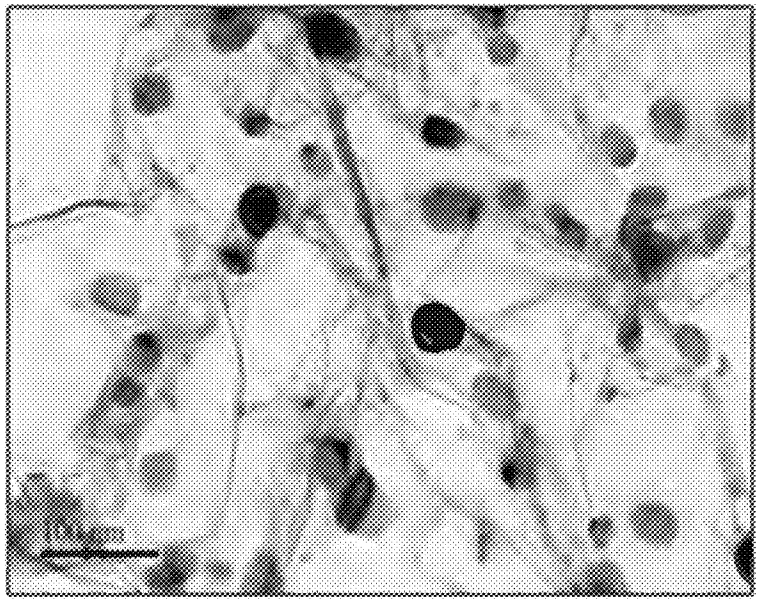
FIG. 8 is a TEM image of the 50% GNs/$Cu_2O$ NPs composite (S2) according to Example 2.
Figure 9:
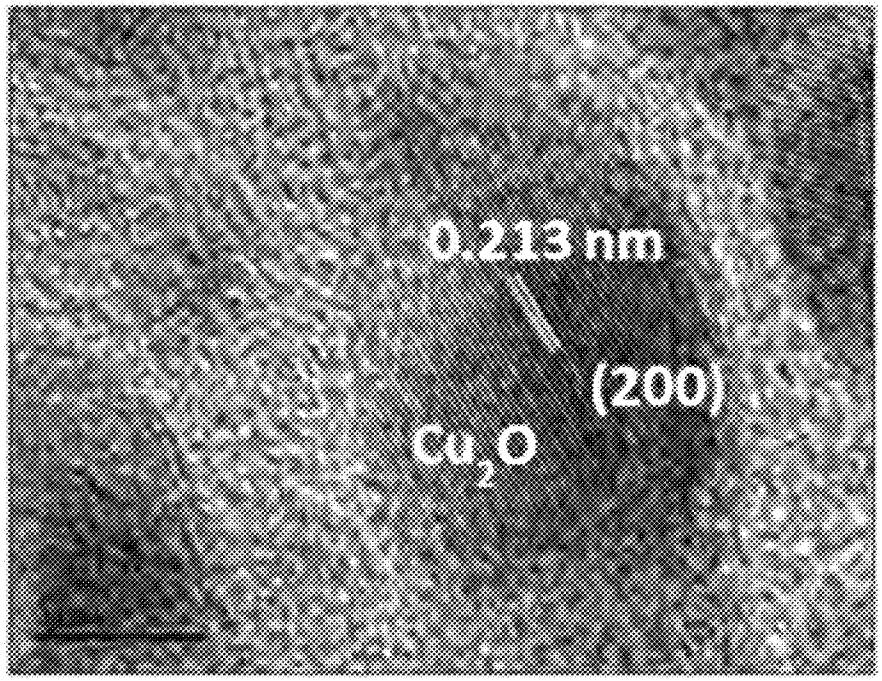
FIG. 9 is a high-resolution TEM (HR-TEM) image of the 50% GNs/$Cu_2O$ NPs composite (S2) according to Example 2.

FIG. 8 is a TEM image of the 50% GNs/$Cu_2O$ NPs composite (S2), showing that the graphene layers wrapped the $Cu_2O$ nanoparticles having an average particle size of around 20-50 nm, consistent with the XRD results and indicating that the cubic structure observed by SEM was formed from many $Cu_2O$ crystals. Crystalline $Cu_2O$ nanoparticles were confirmed by an HR (high resolution)-TEM image of the 50% GNs/$Cu_2O$ NPs composite (S2) presented in FIG. 9, showing the $Cu_2O$ crystal lattice fringes with an inter-planar spacing of 0.213 nm that matches the (200) crystal plane of $Cu_2O$.

Figure 10:
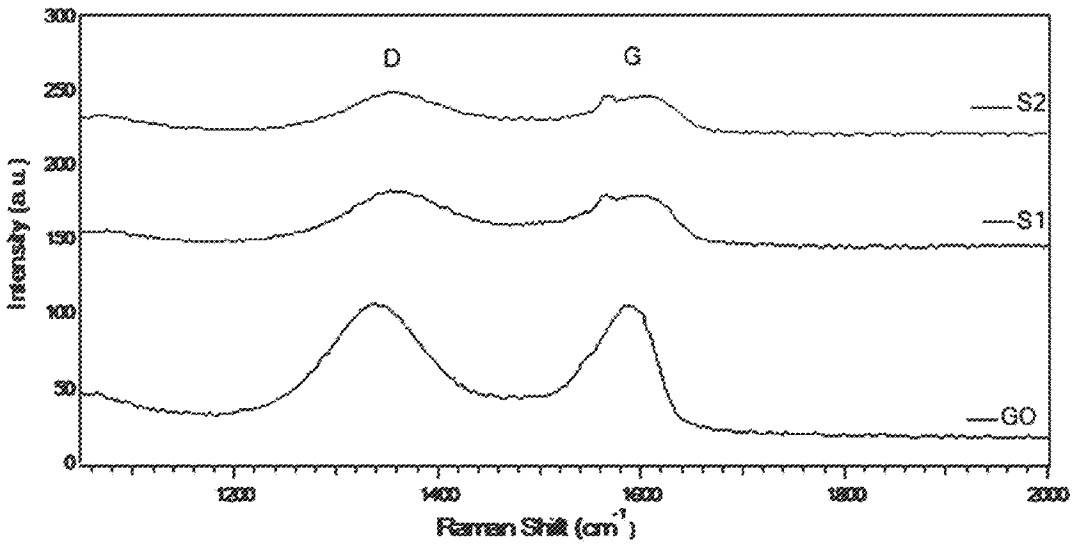
FIG. 10 is a graphical presentation of the Raman spectra of graphene oxide (GO), the 30% GNs/$Cu_2O$ NPs composite (S1), and the 50% GNs/$Cu_2O$ NPs composite (S2) according to Example 2.

Referring to FIG. 10, Raman spectroscopy was used to investigate the reduction of graphene oxide to graphene in the GNs/$Cu_2O$ NPs composites S1 and S2 by examining the G band appearing at 1586 $cm^{-1}$ and the D band appearing at 1350 $cm^{-1}$ in the Raman spectra. The intensity ratio of the D band to the G band (i.e. $I_D/I_G$ ratio) for the GNs/$Cu_2O$ NPs composites increased compared to that for GO, indicating a significant reduction of GO to graphene.

EXAMPLE 3

Electrochemical Studies

Figure 11:
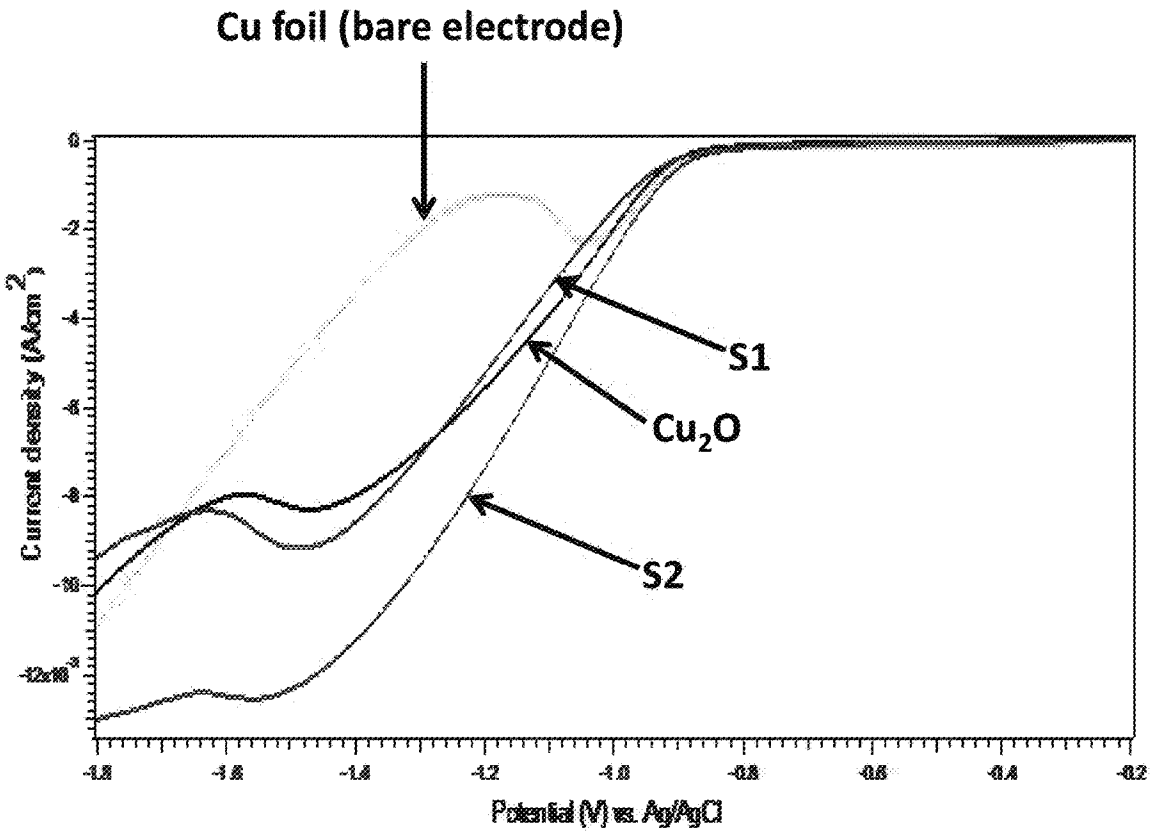
FIG. 11 is a graphical presentation of the results of linear sweep voltammetry (LSV) performed with the (uncoated) Cu foil (bare electrode), the $Cu_2O$ nanoparticle coated Cu foil ($Cu_2O$), the 30% GNs/$Cu_2O$ NPs composite (S1) coated Cu foil, or the 50% GNs/$Cu_2O$ NPs composite (S2) coated Cu foil as the working electrode in a $N_2$ saturated 0.5 M $NaHCO_3$ (pH 7.25) solution at the scan rate of 20 mV/s according to Example 3.

To investigate the electrochemical reduction of $CO_2$ catalyzed by the GNs/$Cu_2O$ NPs composites, voltammograms from linear sweep voltammetry were obtained using the GNs/$Cu_2O$ NPs composite coated. Cu foil as the working electrode as well as the uncoated (bare) Cu foil and the $Cu_2O$ coated Cu foil as the working electrode for comparison. FIG. 11 demonstrates the linear sweep voltammetry curves of the uncoated Cu foil (i.e. bare electrode), the $Cu_2O$ coated Cu foil (represented by $Cu_2O$), the 30% GNs/$Cu_2O$ NPs composite (S1) coated Cu foil, and the 50% GNs/$Cu_2O$ NPs composite (S2) coated Cu foil as the working electrode in a $N_2$ saturated electrolyte solution to clarify the influence of $H_2$ evolution. The current increased as the negative potential increased, reaching a peak at about −1.3 V. This was probably related to reduction of $Cu_2O$. The solution remained clear without any precipitation after reduction at all of the recorded potentials. The reduction current of the uncoated (bare) Cu electrode increased more rapidly starting at −1.7 V than those of the $Cu_2O$ and S1 coated Cu electrodes, indicating inhibition of $H_2$ evolution at the coated Cu electrodes. The S2 coated Cu electrode generally had a higher cathodic current than the S1 coated Cu electrode, particularly at a negative potential more negative than −0.9 V, indicating that the increased addition of graphene to $Cu_2O$ led to increased electron mobility.

Figure 12:
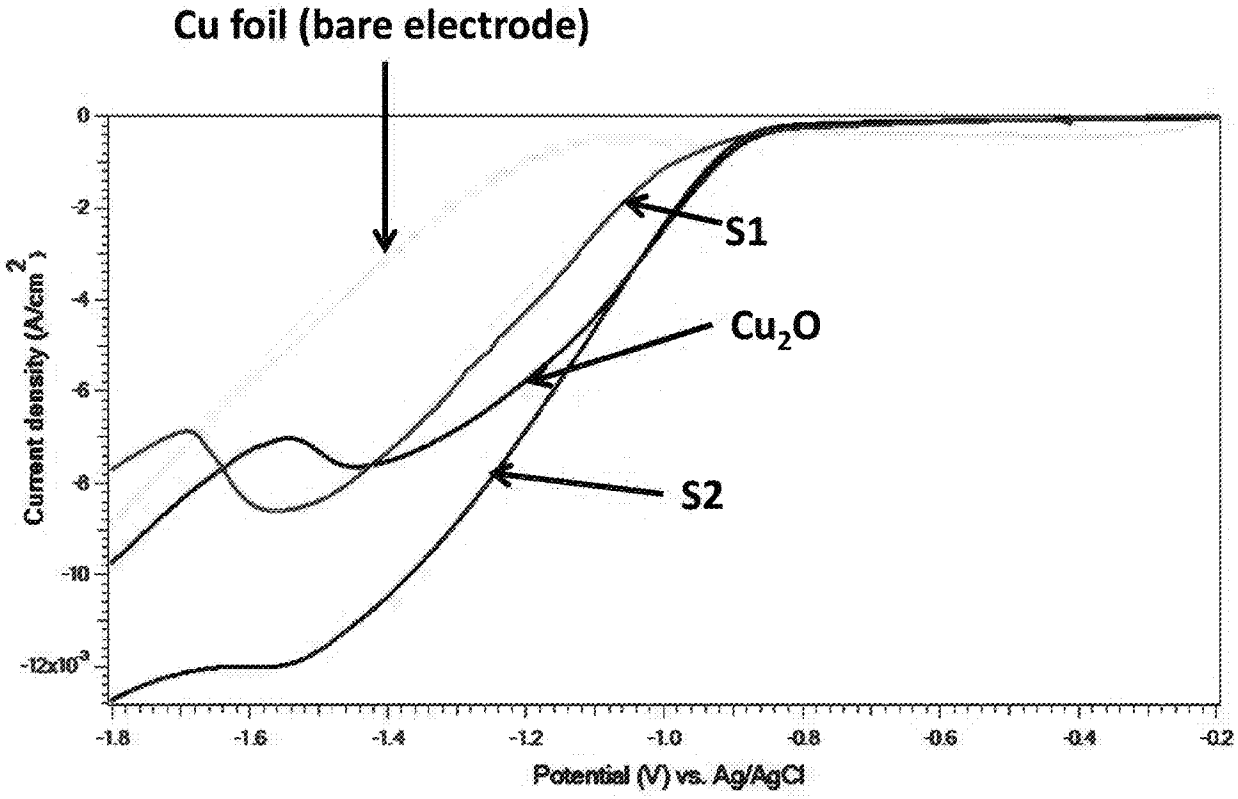
FIG. 12 is a graphical presentation of the results of linear sweep voltammetry (LSV) performed with the (uncoated) Cu foil (bare electrode), the $Cu_2O$ nanoparticle coated Cu foil ($Cu_2O$), the 30% GNs/$Cu_2O$ NPs composite (S1) coated Cu foil, or the 50% GNs/$Cu_2O$ NPs composite (S2) coated Cu foil as the working electrode in a $CO_2$ saturated 0.5 M $NaHCO_3$ (pH 7.25) solution at the scan rate of 20 mV/s according to Example 3.
Figure 13:
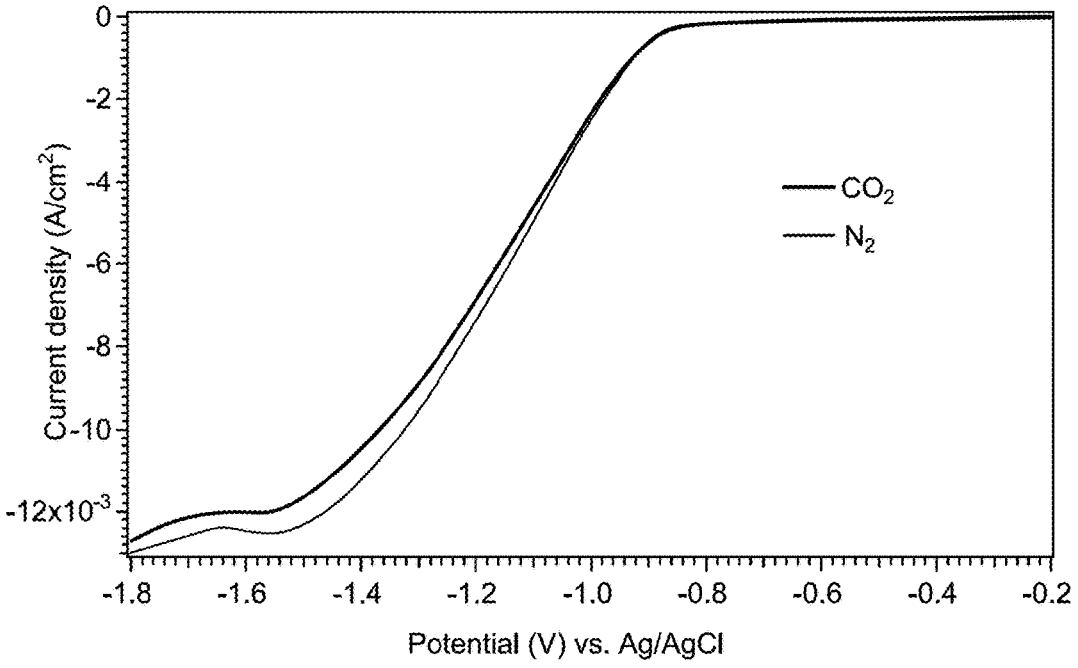
FIG. 13 is a graphical presentation of the results of linear sweep voltammetry (LSV) performed with the 50% GNs/$Cu_2O$ NPs composite (S2) coated Cu foil as the working electrode in a $CO_2$ or $N_2$ saturated 0.5 M $NaHCO_3$ (pH 7.25) solution at the scan rate of 20 mV/s according to Example 3.

FIG. 12 illustrated the linear sweep voltammetry curves of the uncoated and coated Cu electrodes in a $CO_2$ saturated electrolyte solution. Compared to the $Cu_2O$ coated Cu electrode, the 30% GNs/$Cu_2O$ NPs composite (S1) coated Cu electrode showed a lower cathodic current at a potential from −0.9 to −1.42 V and a higher cathodic current at a potential from −1.42 to −1.64 V. By contrast, the 50% GN/$Cu_2O$ NPs composite (S2) coated Cu electrode generally had a higher cathodic current than the $Cu_2O$ coated Cu electrode. For instance, at −1.7 V the $Cu_2O$ coated Cu electrode displayed a current density of 8.4 $mA/cm^2$, whereas the 50% GNs/$Cu_2O$ NPs composite (S2) coated. Cu electrode displayed a current density of 12.2 $mA/cm^2$, which is a very high cathodic current density for a copper based electrode with a relatively low loading of electrocatalysts as compared to other electrocatalyst modified Cu-based electrodes reported in the literature shown in Table 1. The current density results indicate that graphene facilitated and increased the electron mobility on the electrode surface and that graphene incorporated with $Cu_2O$ improved the $CO_2$ reduction. Referring to FIG. 13, the current density of the S2 coated Cu electrode was generally lower in the $CO_2$ saturated electrolyte solution than in the $N_2$ saturated electrolyte solution, because of a competition between hydrogen evolution reaction (HER) and $CO_2$ reduction at the electrode surface and the inhibition of $H_2$ evolution by adsorbed species on the electrode surface during $CO_2$ reduction. See T. Chang, R. Liang, P. Wu, J. Chen, Y. Hsieh, Electrochemical reduction of $CO_2$ by $Cu_2O$-catalyzed carbon clothes, *Materials Letters* 63 (2009) 1001-1003, incorporated herein by reference in its entirety.

Figure 14:
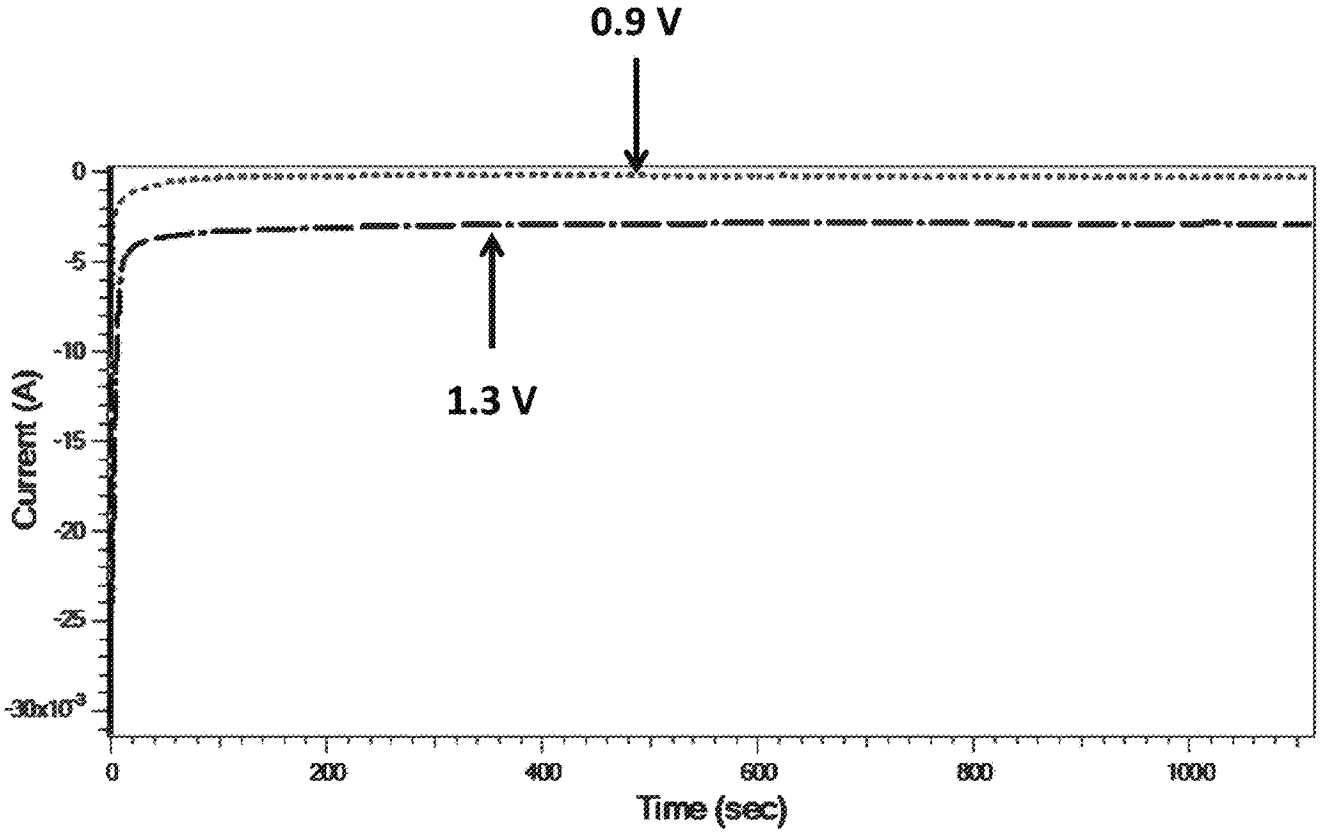
FIG. 14 is a graphical presentation showing the current response versus time of the 50% GNs/$Cu_2O$ NPs composite (S2) coated Cu foil operating as the working electrode at different potentials in a $CO_2$ saturated 0.5 M $NaHCO_3$ (pH 7.25) solution according to Example 3.

FIG. 14 shows the total current density versus time of the 50% GNs/$Cu_2O$ NPs composite (S2) coated Cu electrode at two different potentials of −0.9 V and −1.3 V vs. the Ag/AgCl reference electrode. In good agreement with the linear sweep voltammetry results, the current density increased as the negative potential increased. Moreover, the current density at both potentials started at a high current density and decreased with time. At −0.9 V, the current density of the S2 coated Cu electrode started at −10 mA and declined slowly to −0.5 mA after 20 min. Likewise at −1.3 V, the S2 coated Cu electrode exhibited an initial current density of −31 mA, which decreased rapidly to −4 mA after 20 seconds of electrolysis and remained constant at −4 mA for the remainder of the experiment. The fluctuation in current density of the electrode at both potentials may be due to hydrogen evolution and detachment of $Cu_2O$ from the electrode surface. See J. Albo, A. Saez, J. Solla-Gullon, V. Montiel, A. Irabien, Production of methanol from $CO_2$ electroreduction at $Cu_2O$ and $Cu_2O$/ZnO-based electrodes in aqueous solution, *Appl. Catal. B: Enviromnen,* 176-177 (2015) 709-717; M. Le, M. Ren, Z. Zhang, P. T. Sprunger, R. L. Kurtz, J. C. Flake, Electrochemical reduction of $CO_2$ to $CH_3OH$ at copper oxide surfaces, *J. Electrochem. Soc.* 158 (5) (2011) E45-E49; and L. M. Aeshala, R. G. uppaluri, A. Verma, Effect of cationic and anionic solid polymer electrolyte on direct electrochemical reduction of gaseous $CO_2$ to fuel, *J. $CO_2$ Util.* 3-4 (2013) 49-55, each incorporated herein by reference in its entirety.

TABLE 1

Comparison of Faradaic efficiency (FE) for ethanol production on different copper based electrodes reported in literature and this disclosure

| Catalyst | Electrolyte/Condition | FE (%) of Ethanol Production | Ref. |
|---|---|---|---|
| Electropolished Cu | 0.1M $KHCO_3$/ −0.99 V vs. RHE | N.D. (not detectable) | 1 |
| 0.1 μm $Cu_2O$ | 0.1M $KHCO_3$/ −0.99 V vs. RHE | 6 | |

TABLE 1-continued

Comparison of Faradaic efficiency (FE) for ethanol production on different copper based electrodes reported in literature and this disclosure

| Catalyst | Electrolyte/Condition | FE (%) of Ethanol Production | Ref. |
|---|---|---|---|
| 3.6 μm $Cu_2O$ | 0.1M $KHCO_3$/ −0.99 V vs. RHE | 16.37 | |
| Polycrystalline Cu | 0.1M $KHCO_3$/ −5 mA/cm$^2$ | 6.9 | 2 |
| Electrodeposited $Cu_2O$ | 0.5M $KHCO_3$/ −1.82 V vs. Ag/AgCl | N.R. (not reported) | 3 |
| Cu (100) | 0.1M $KHCO_3$/ −5 mA/cm$^2$ | 9.7 | 4 |
| 50% GNs/$Cu_2O$ NPs (0.1 mg) | 0.5M $NaHCO_3$/ −0.9 V vs. Ag/AgCl | 9.93 | This disclosure |

Refs:

1 D. Ren, Y. Deng, A. D. Handoko, C. S. Chen, S. Malkhandi, B. S. Yeo, Selective electrochemical reduction of carbon dioxide to ethylene and ethanol on copper (I) oxide catalysts, ACS Catalysis, 2015, 5, 2814-2821, incorporated herein by reference in its entirety.

2 Y. Hori, A. Murata, R. Takahashi, Formation of hydrocarbons in the electrochemical reduction of carbon dioxide at a copper electrode in aqueous solution, Journal of the Chemical Society, Faraday Transactions 1 1989, 85, 2309-2326, incorporated herein by reference in its entirety.

3 D. Kim, S. Lee, J. D. Ocon, B. Jeong, J. K. Lee, J. Lee, Insights into an autonomously formed oxygen-evacuated $Cu_2O$ electrode for the selective production of $C_2H_4$ from $CO_2$, Physical Chemistry Chemical Physics 2015, 17, 824-830, incorporated herein by reference in its entirety.

4 Y. Hori, I. Takahashi, O. Koga, N. Hoshi, Electrochemical reduction of carbon dioxide at various series of copper single crystal electrodes, Journal of the Molecular Catalysis A: Chemical 2003, 199, 39-47, incorporated herein by reference in its entirety.

Using gas chromatography-mass spectrometry (GC-MS), ethanol was detected after 20 min of electrolysis with the S2 coated. Cu electrode and with 30 min of bubbling $CO_2$ into the electrolyte solution, and found to be the predominant liquid-phase reduction product at room temperature and atmospheric pressure. The production of ethanol from the electrochemical reduction of $CO_2$ was confilined by comparing the GC-MS result of the liquid-phase reduction product with that of a standard ethanol solution that showed the retention time of ethanol at 1.66 min. Further, the production of ethanol from the electrochemical reduction of $CO_2$ took place at both −0.9 V and −1.3 V vs. AgAgCl, and was found to depend strongly on the potential applied to the S2 coated Cu electrode. Table 2 shows the faradic efficiency of ethanol production at the above two potentials. Table 1 compares the faradaic efficiency of ethanol production at the S2 coated Cu electrode with those at other copper based electrodes reported in the literature. The S2 coated Cu electrode seemed to be selective towards ethanol production. The decrease in faradaic efficiency of ethanol production at −1.3 V may be due to electrode deactivation caused by some reduction product species adsorbed on the electrode surface, since some bubbles on the electrode surface were observed at this potential but not at −0.9 V. Potential gas phase products were not investigated during this study. An increased $CO_2$ conversion efficiency may be likely with increasing composite material loading, electrolysis time, and $CO_2$ bubbling time.

TABLE 2

Faradaic efficiency (FE) of ethanol production by reduction of $CO_2$ with the 50% GNs/$Cu_2O$ NPs composite (S2) coated Cu electrode at two different potentials

| Electrode potential (vs. Ag/AgCl) | Current density (mA/cm$^2$) | Charge (C) | Ethanol conc. (ppm) | FE (%) |
|---|---|---|---|---|
| −0.9 | 0.5257 | 2.1324 | 0.3369 | 9.93 |
| −1.3 | 2.754 | 11.1708 | 1.2 | 6.75 |

Faradaic efficiency of ethanol production was calculated based on electrochemical reduction of $CO_2$

The invention claimed is:

1. A method of reducing $CO_2$ to form ethanol, the method comprising:

(a) contacting an electrode system with an aqueous solution comprising at least one electrolyte and $CO_2$, wherein the electrode system comprises a working electrode, a counter electrode, and a reference electrode, wherein the working electrode comprises a copper metal base electrode and a coating of a composite comprising graphene nanosheets and $Cu_2O$ nanoparticles disposed on a surface of the copper metal base electrode, and (b) applying a negative potential to the working electrode to reduce the $CO_2$ and form the ethanol, wherein ethanol is the predominant alcohol product formed from the reduction of the $CO_2$.

2. The method of claim 1, wherein the contacting is performed in a divided electrochemical cell comprising the counter electrode in a first cell compartment and the working electrode in a second cell compartment, wherein the aqueous solution is present in the first and the second cell compartment.

3. The method of claim 1, wherein the $Cu_2O$ nanoparticles are disposed on a surface of the graphene nanosheets in the composite.

4. The method of claim 1, wherein the $Cu_2O$ nanoparticles have an average particle size of 20-50 nm.

5. The method of claim 4, wherein a plurality of the $Cu_2O$ nanoparticles form a cubic cluster with the longest edge of 60-200 nm.

6. The method of claim 5, wherein the graphene nanosheets enclose the cubic cluster of the $Cu_2O$ nanoparticles in the composite.

7. The method of claim 1, wherein the composite has a weight ratio of the graphene nanosheets: the $Cu_2O$ nanoparticles in the range of 0.2-0.8.

8. The method of claim 1, wherein an amount of the coating of the composite disposed on the surface of the copper metal base electrode is 0.01-0.5 mg/cm$^2$ surface area of the copper metal base electrode.

9. The method of claim 1, wherein the reference electrode is an Ag/AgCl reference electrode, and wherein the negative potential is from −0.9 V to −1.3 V.

10. The method of claim 9, wherein the $CO_2$ is reduced to the ethanol at the working electrode with a faradaic efficiency of 5-10%.

11. The method of claim 9, wherein the working electrode has a current density of 0.5-3 mA/cm$^2$.

12. The method of claim 1, wherein the aqueous solution is saturated with the $CO_2$.

* * * * *